United States Patent [19]

Shoemaker

[11] Patent Number: 4,914,445

[45] Date of Patent: Apr. 3, 1990

[54] MICROSTRIP ANTENNAS AND MULTIPLE RADIATOR ARRAY ANTENNAS

[76] Inventor: Kevin O. Shoemaker, P.O. Box 322, Morrison, Colo. 80465

[21] Appl. No.: 289,248

[22] Filed: Dec. 23, 1988

[51] Int. Cl.[4] ..... H01Q 1/38

[52] U.S. Cl. ..... 343/700 MS; 343/853

[58] Field of Search ..... 343/700 MS, 853, 846, 343/830, 829

[56] References Cited

U.S. PATENT DOCUMENTS

| | | | |
|---|---|---|---|
| Re. 29,911 | 2/1979 | Munson | 343/700 MS |
| 3,803,623 | 4/1974 | Charlot, Jr. | 343/846 |
| 3,987,455 | 10/1976 | Olyphant, Jr. | 343/829 |
| 3,995,277 | 11/1976 | Olyphant, Jr. | 343/846 |
| 4,173,019 | 10/1979 | Williams | 343/700 MS |
| 4,180,817 | 12/1979 | Sanford | 343/700 MS |
| 4,686,535 | 8/1987 | Lalezari | 343/700 MS |
| 4,761,653 | 8/1988 | Owens et al. | 343/700 MS |

FOREIGN PATENT DOCUMENTS

| | | | |
|---|---|---|---|
| 2046530 | 11/1980 | United Kingdom | 343/700 MS |
| 2131232 | 6/1984 | United Kingdom | 343/700 MS |

*Primary Examiner*—Rolf Hille
*Assistant Examiner*—Doris J. Johnson
*Attorney, Agent, or Firm*—Fields, Lewis, Pittenger & Rost

[57] ABSTRACT

Microstrip antennas disclosed have one or a plurality of radiators arranged in selected arrays wherein a different and preferably lower dielectric layer is provided between the radiator and ground reference than between the feedline and ground reference. Relatively inexpensive and durable dielectric layers of polyethylene having a dielectric constant between 1.05 and 1.5 have been found suitable for between the radiator and ground reference and air for between the feedlines and ground reference. Arrays of four of the radiators disclosed provide for both horizontal and vertical polarization, isolated polarizations and circular polarization of wave energy. The radiators are series-corporate fed and corporate fed.

23 Claims, 4 Drawing Sheets

MICROSTRIP ANTENNAS AND MULTIPLE RADIATOR ARRAY ANTENNAS

TECHNICAL FIELD

This invention relates to a novel and improved microstrip antennas and arrays of radiators in microstrip antennas.

BACKGROUND ART

Microstrip antennas for wave propagation heretofore provided have, in general, included a ground reference, and one or more thin flat conductive radiators to which is connected thin flat conductive feedlines. The radiators and feedlines have heretofore been mounted on a common dielectric layer of a relatively high cost. The dielectric material heretofore utilized in antennas of this type has been a teflon fiberglass which is a solid material having a dielectric constant of about 2.3 to 2.6. This material has been relatively expensive as on the order of one to several hundred dollars per square foot. The loss tangent (dissipation factor) is about 0.001 at $10^9$ Hz.

U.S. Pat. Nos. 3,803,623, 3,995,277, 3,987,455, 4,180,817 and Re. 29,911 are examples of prior art disclosures pertaining to microstrip antennas. There is a need for low cost, light weight, durable, readily mass producible antennas of useful bandwidth in a variety of mass market applications.

DISCLOSURE OF THE INVENTION

Microstrip antennas disclosed have a different dielectric constant for the dielectric layer between the radiator and the ground reference than between the feedline and the ground reference with the latter being a lower value to provide for improved performance and low feedline losses. The dielectric layer between the radiator and ground reference is of a lower value and of a less costly material than dielectric layers heretofore used in microstrip antennas.

Arrays of four of the radiators disclosed provide for both horizontal and vertical polarization, isolated polarizations and circular polarization of wave energy. The radiators are series-corporate fed and corporate fed.

DETAILED DESCRIPTION

Figure 1:
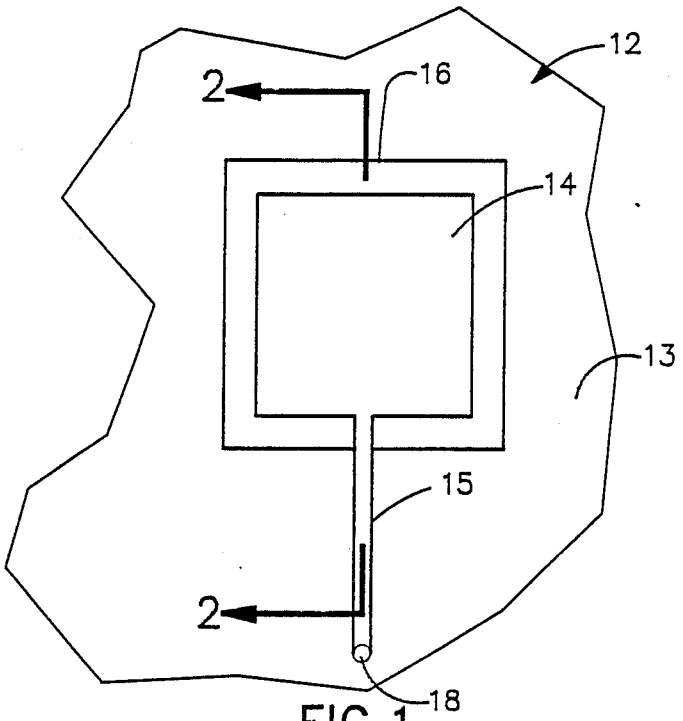
FIG. 1 is a top plan view of a microstrip antenna embodying features of the present invention suitable for a linear polarization of wave energy.
Figure 2:
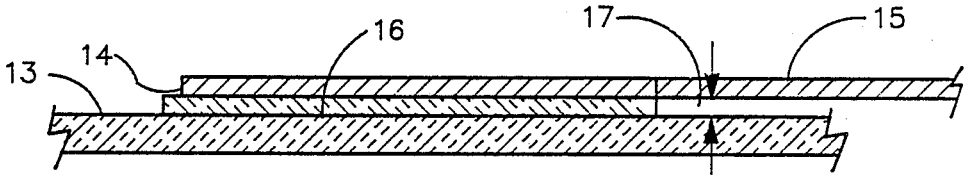
FIG. 2 is a sectional view taken along line 2—2 of FIG. 1 with the thickness of the layers greatly exaggerated for illustration purposes.

Referring now to the drawings, there is shown in FIGS. 1 and 2 a microstrip antenna 12 which includes a ground reference 13, a radiator 14, and a feedline 15 connected at one end to the bottom edge of radiator 14. A feedpoint 18 is at the end of the feedline opposite its connection with the radiator. A dielectric layer or substrate 16 is disposed between the radiator 14 and ground reference 13 and a dielectric layer 17 disposed between the feedline and the ground reference 13. The edge of dielectric layer 16 is shown to extend a slight distance beyond the edge of the radiator 14 to provide for the containment of an electrical field about the radiator. This distance preferably is at least two to three times the thickness of dielectric layer 16.

In the embodiment shown in FIGS. 1 and 2, the ground reference is straight flat or straight planar and the radiators, feedlines and dielectrics are also straight flat or straight planar. Both the radiator 14 and the dielectric layers 16 and 17 are arranged parallel to the ground reference 13. It is understood, however, that the ground reference 13 can vary in shape or contour from the straight, flat plane shown such as, for example, to a concave plane or convex plane or other curved planar surface. The term "generally planar" as used herein is intended to refer to both straight and curved planar surfaces. The ground reference 13 may conform to the shape of many different surfaces on which an antenna may be mounted so the ground reference may also be referred to as conformal to a supporting surface for the antenna.

As used herein the term "polarization" indicates the plane of the electric lines of force relative to the horizontal surface of the earth. With reference to the illustrations in the drawings, horizontal electric lines of force extend across or laterally of the drawing to indicate horizontal polarization and vertical electric lines of force extend up or down on the drawing to indicate vertical polarization. Linear polarization refers to either horizontal or vertical polarization. The combination of both horizontal and vertical electric lines of force indicate copolar or slant linear polarization and can also be combined to create left hand or right hand polarization. Electric lines that extend in a circle in a clockwise direction is right hand circular polarization. Electric lines that extend in a circle in a counterclockwise direction is left hand circular polarization.

The radiator 14 shown is in the form of a thin conductive patch and each feedline a thin conductive narrow strip. The patches shown are of a square shape to reduce bandwidth but it is understood that rectangular shapes of selected length and width dimensions can also be used. Preferably, the patch and feedline are made as a single integral strip using photolithograph techniques. A preferred material for the patch and feedline is copper dipped in a tin immersion to prevent corrosion. A preferred thickness is about 0.0015 in. The ground reference 13 is provided by the top surface of a flat conductive rigid sheet of uniform thickness made of aluminum, steel or like conductive material that provides support for the other antenna elements which are disposed on and affixed to this rigid sheet. Aluminum at a thickness of 0.125 inches and steel at a thickness of 0.0625 inches is suitable for this sheet.

The dielectric layer 16 under the radiator preferably is a thin film, preferably a polyolefin and more particularly a polyethylene onto which the radiator is formed and is an integral part. The dielectric constant for the dielectric layer under the radiator is of a lower value than in prior art antennas and preferably is from about 1.01 to 1.50. The dielectric constant of the dielectric layer under the feedline 15 is different from that under the radiator 14 and in the form shown is air having a dielectric constant of 1.0. This arrangement of dielectric layers results in providing optimum bandwidth, optimum beamwidth and optimized gain for the radiator and minimum conductive and dielectric losses for the feedline.

Figure 3:
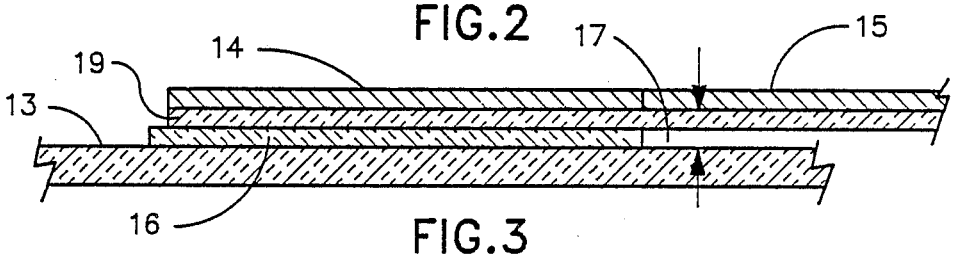
FIG. 3 is a cross-sectional view of another form of microstrip antenna modified from that of FIG. 2 showing a carrier layer supporting the radiator.

One way of providing the radiators 14 shown in FIG. 3 is to have a conductive sheet bonded to a carrier layer 19 of film of uniform thickness, preferably mylar, and remove the conductive sheet from the carrier layer except for the radiators and feedlines. This may be done using a known photolithographic process.

An example of a material found particularly suitable for use as dielectric layer 16 according to the present invention is as follows:

| | |
|---|---|
| Polyethylene | 1.8 to 2.2 |
| Closed-cell semi-rigid | |
| Density | |
| Thermal Conductivity | |
| BTU/Sq. Ft./Hr./°F./in. | .35 @ 70° mean temp. |
| Tensil Strength, psi | 20 to 30 |
| Maximum Service Temp. | 160° F. |
| Burning rate | 2.5 in/min. |
| Dielectric Constant | 1.05 @ $10^9$ hz |
| Loss Tangent (Dissipation Factor) | .0002 @ $10^9$ hz |

Materials of this type are available for a relatively low cost on the order of a few cents per square foot.

An example of a material found suitable for use as carrier layer 20 is as follows:

| Mylar | |
|---|---|
| Dielectric Constant @ $10^6$ hz | 2.3–2.6 |
| Dissipation Factor @ $10^6$ hz | .01–.03 |
| Water Absorption, %, 1/16" | .2–.4 |
| Thickness | .001–.005 in. |

Figure 4:
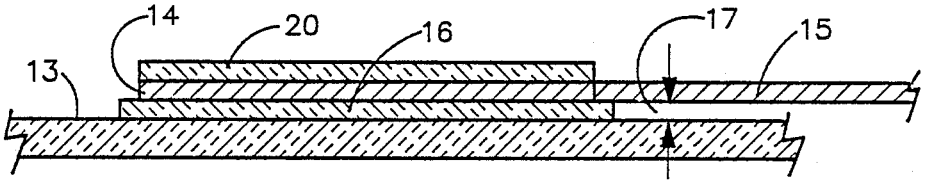
FIG. 4 is a sectional view of another form of microstrip antenna modified from that shown in FIG. 2 using a superstrate layer on top of the radiator.

Referring now to FIG. 4 there is shown another form of microstrip antenna wherein a layer of superstrate 20 is placed over the radiator 14 and has the same general dimension as the radiator 14. This provides considerably greater gain for the antenna on the magnitude of an increase of a factor of five. A suitable material for this purpose is alumina having a dielectric constant of about 10. Materials having dielectric constants in the range of 6 to 12 would be suitable for this purpose.

Figure 5:
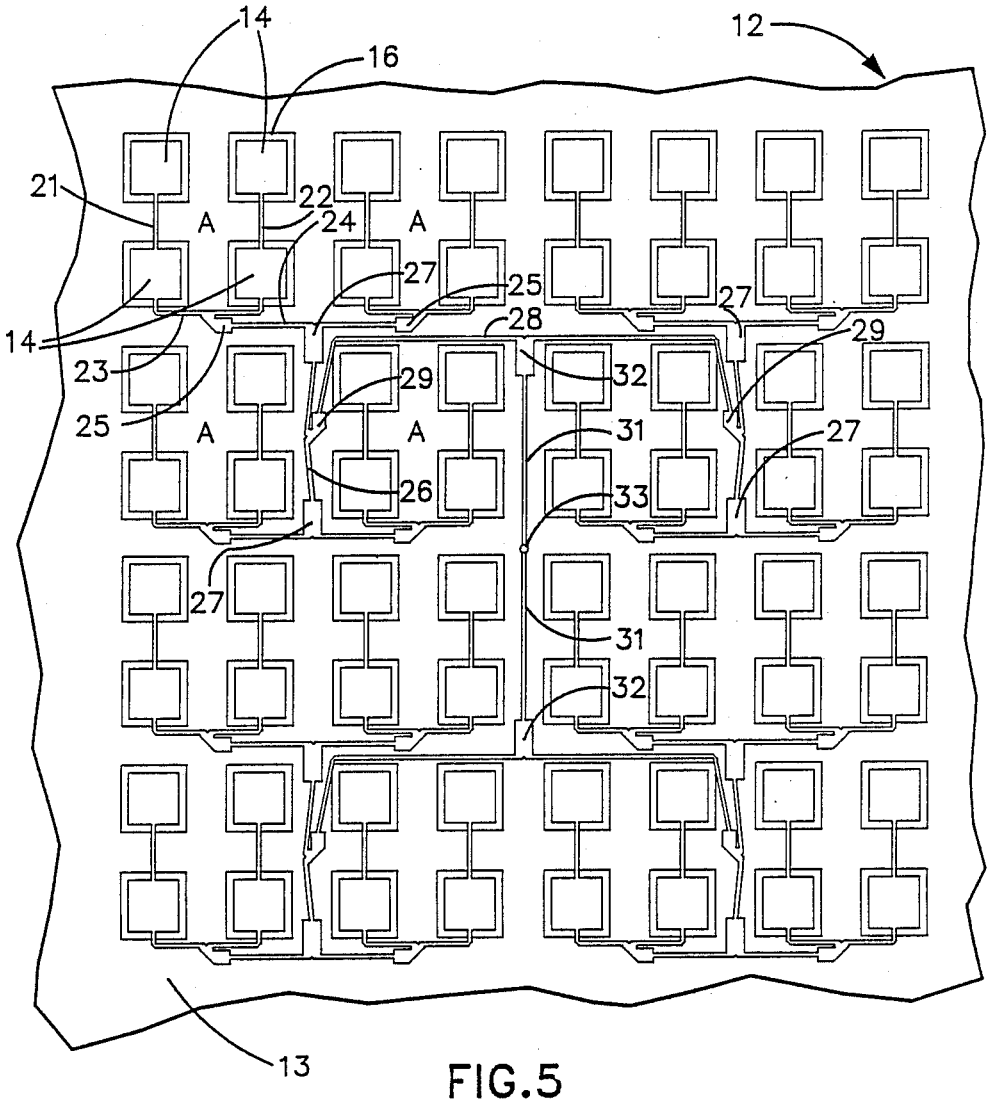
FIG. 5 is a top plan view of a multiple radiator array microstrip antenna embodying features of the present invention.

A multiple radiator array microstrip antenna shown in FIG. 5 has in the upper left hand corner of the drawing an array A of four, spaced apart, identical radiators 14 arranged as an upper left, upper right, lower left and lower right and herein referred to as the first, second, third and fourth radiators, respectively. These radiators in the array A may frrther be described as disposed in spatial relation in a common plane. Each radiator 14 is a length of about a half wave length ($\lambda/2$) and the radiators are a length of about a half wave length ($\lambda/2$) apart as measured from edge to adjacent edge.

A first feedline 21 is connected between the top and bottom edges along vertical center lines of the upper left and lower left radiators, respectively and a second feedline 22 is connected between the top and bottom edges along vertical center lines of the upper right and lower left radiators, respectively to form two series-connected radiator arrays arranged side by side. A third feedline 23 is connected to the bottom ends of the two series-connected arrays having portions in line with the first and second feedlines so that the radiators and feedlines provide for linear and more specifically vertical polarization of wave energy. It is understood that feedline 23 could also be connected to the top ends of the top radiators and provide a similar result.

A feedline 24 connects from a transformer segment 25 at the combining point midway between the ends of feedline 24 to a corresponding transformer segment on an adjacent four-radiator array A to the right of the first described array A. A feedline 26 connects from a transformer segment 27 at the combining point midway between the ends of feedline 24 to a corresponding transformer segment 27 of two lower adjacent four-radiator arrays A. The transformer segments 25 and 27 and those described subsequent hereto are for the purpose of impedance matching.

A feedline 28 connects from a transformer segment 29 at the combining point midway between the ends of feedline 26 to a corresponding transformer segment 29 of four adjacent four-radiator arrays to the right of the four four-radiator arrays previously described.

A feedline 31 connects from a transformer segment 32 at the combining point midway between the ends of feedline 28 to a corresponding transformer segment 32 of eight, four-radiator arrays below the eight four-radiator arrays previously described. The feedpoint for the sixty-four radiators shown in FIG. 5 is at the middle of or midway between the ends of feedline 31.

Figure 6:
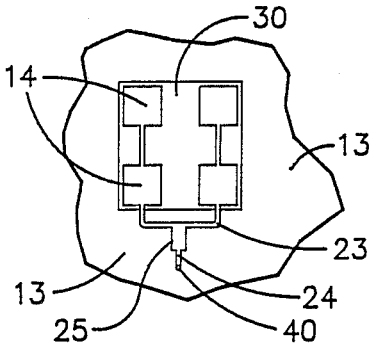
FIG. 6 is another form of multiple radiator array microstrip antenna using a single dielectric sheet supporting an array of four radiators.

Referring now to FIG. 6, the alternative form shown of a four-radiator array microstrip antenna has a single sheet 30 of dielectric layer under the array of four radiators 14. The feedline 23 connected to the bottom ends of the two series-connected arrays has the air gap between the feedline 23 and the ground reference 13 in the same way as is shown in FIG. 5. The feedpoint 40 for this array is at the end of feedline 24 opposite its connection with feedline 19 via transformer segment 25.

It can be readily shown by using the basic equation for the impedance of the equivalent circuit for a microstrip radiator that bandwidth, beamwidth and gain parameters vary proportionately with the dielectric constant ($\epsilon_r$) of the dielectric layer 16 using a dielectric layer having the same (uniform) height or thickness. Further, it can be readily shown by using the basic equation for the impedance of the equivalent circuit for the microstrip feedline that the conductive losses and dielectric losses vary directly in relation to the dielectric constant of the dielectric layer.

Figure 7:
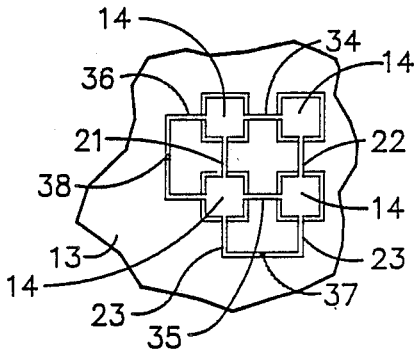
FIG. 7 is a top plan view of another form of microstrip antenna arranged to provide for both horizontal and vertical polarization.

Referring now to FIG. 7 there is shown a four-radiator array microstrip antenna similar to those shown in FIGS. 5 and 6. A vertical polarization feedpoint 37 is located at the combining point midway between the ends of feedline 23. In addition, there is provided a fourth feedline 34 connected between the sides of the upper left and upper right radiators and a fifth feedline 35 is connected between the sides of the lower left and lower right radiators to form a set of two series-connected arrays. A sixth feedline 36 is connected between the left sides of the two series-connected arrays at the upper left and lower left radiators. Feedline 36 has portions in line with the fourth and fifth feedlines and a horizontal polarization feedpoint 38 is located midway between the ends of feedline 36 so the radiators provide for horizontal polarization of wave energy. Again, it is understood that feedline 36 could be connected to the right sides of the upper right and lower right radiators to provide a similar result. This arrangement, then, provides for vertical polarization of radiated energy at feedpoint 37 and further provides for horizontal polarization at feedpoint 38.

Figure 8:
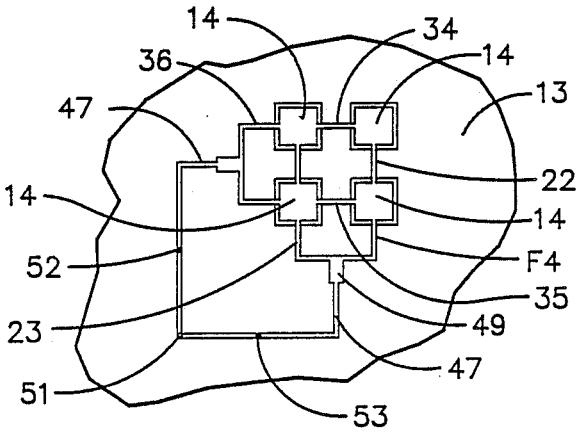
FIG. 8 is a top plan view of another form of microstrip antenna with additional feedlines from that of FIG. 5 using to provide horizontal or vertical isolated polarizations.

Referring now to FIG. 8 there is shown a four-radiator array microstrip antenna connected similar to the array shown in FIG. 7 but further includes a seventh feedline 47 that connects from a transformer segment 48 at the combining point midway between the ends of feedline 36 and to a transformer segment 49 at the combining point midway between the ends of feedline 23. In this arrangement wave energy at a feedpoint 51 midway between the combining points of feedlines 23 and 36 provides slant or linear polarization, a feedpoint 52 a quarter wave length distance from combining point of feedline 48 toward feedline 48 provides right hand circular polarization and a feedpoint 53 a quarter wave length distance from combining point of feedline 23 toward feedline 23 provides left hand circular polarization.

Figure 9:
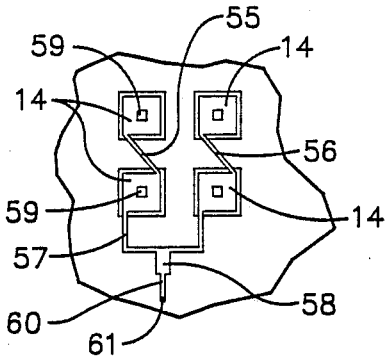
FIG. 9 is a top plan view of another form of microstrip antenna arranged to provide circular polarization.

Referring now to FIG. 9 there is shown a four-radiator array microstrip antenna wherein a first feedline 55 is connected between the lower left hand corner of the upper left radiator and the upper right hand corner of the lower left radiator and a second feedline 56 is connected between the lower left hand corner of the third radiator and the upper right hand corner of the fourth radiator. There is further provided a third feedline 57 connected between the lower left hand corner of the lower left radiator and the lower left hand corner of the lower right radiator. A transformer segment 58 is connected at the combining point midway between the ends of feedline 57. Each radiator shown in FIG. 9 has an aperture 59 which is the same square shape but approximately a quarter of the width of the radiator. A feedline 60 connected to segment 58 has a feedpoint 61 for this antenna. This arrangement provides for circular polarization of wave energy.

Figure 10:
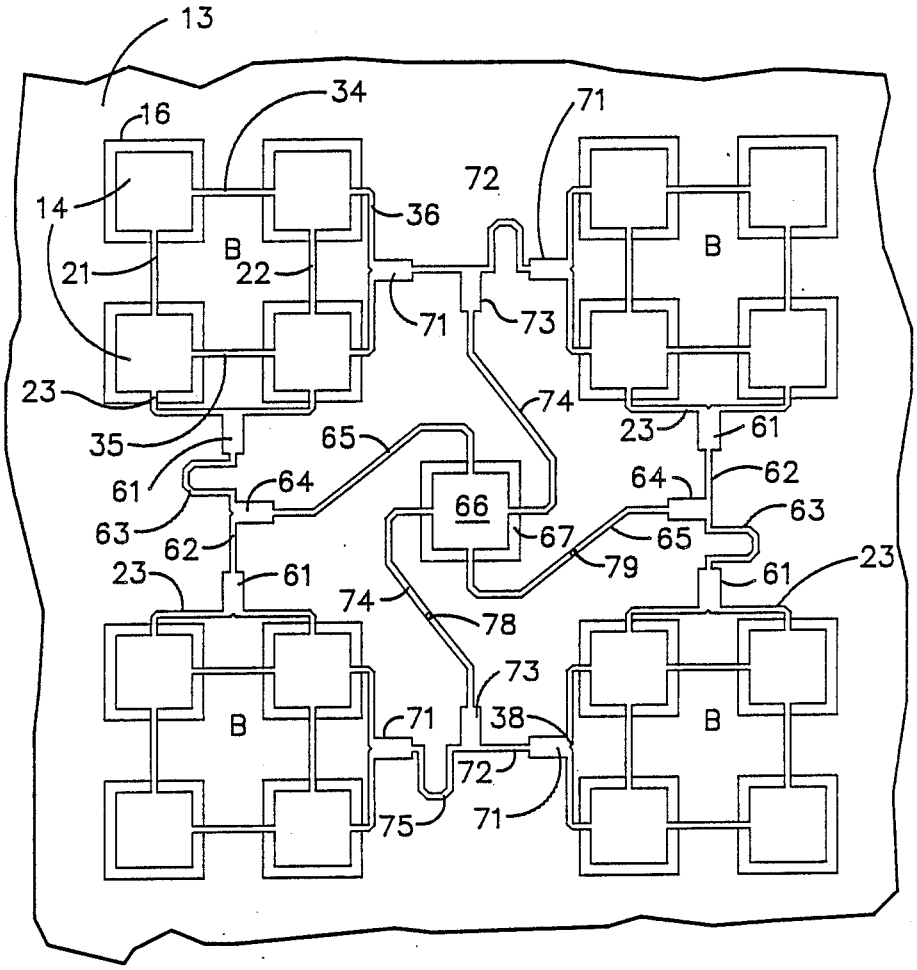
FIG. 10 is a top plan view of another embodiment of a multiple radiator array microstrip antenna.

Referring now to FIG. 10 there is shown a microstrip antenna including four, four-radiator arrays B connected in a manner similar to FIG. 7 above described. A feedline 62 is connected between the vertical polarization combining points midway between the ends of feedline 23 of the upper left array and the lower left array. Similarly, a feedline 62 is connected between the vertical polarization combining points midway between the end of feedline 23 of the upper right array and the lower right array. A transformer segment 61 connects in the ends of feedline 62. A 180 degree phase shifter 63 connects in feedline 62 to put the wave energy at the combining point midway between the ends of feedline 62 in phase. A feedline 65 for the two left arrays connects at one end at a transformer segment 64 to the combining point midway between the ends of feedline 62 and at the other end to the top side of a power patch 66 and while another feedline 65 from the two right arrays connects to the bottom side of power patch 66 to apply the vertical polarization thereto.

A feedline 72 is connected between the horizontal polarization combining point midway between the ends of feedline 36 for the two upper arrays and also between the horizontal polarization combining point midway between the ends of feedline 36 of the two lower arrays. A transformer segment 71 connects at each of the ends of feedline 72. A 180 degree phase shifter 75 connects in the feedline 72 to put the energy at the combining point midway between the ends of feedline 72 in phase. A feedline 74 connects at one end at a transformer segment 73 to the combining point midway between the ends of feedline 72 and at the other end to the right side of patch 66 for the two upper arrays and to the left side of patch 66 for the two lower arrays. A dielectric layer 67 is provided between the patch 68 and the ground reference. A horizontal polarization feedpoint 78 is provided on feedline 74 associated with the two lower arrays. The horizontal polarization feedpoint 78 is located an integral number of wavelengths from the combining points on feedline 72. A vertical polarization feedpoint 79 is provided on feedline 65 associated with the two right arrays. The vertical polarization feedpoint 79 is located an integral number of wavelengths from the combining points on feedline 62.

With this arrangement the vertical polarization wave energy from the upper and lower left arrays at the top of the power patch 66 and the vertical polarization wave energy from the upper and lower right arrays are applied to the bottom of the power patch cross the zero axis at the same time to isolate one from the other. The horizontal polarization wave energy from the upper arrays applied to the right side of the power patch and the horizontal polarization wave energy from the lower arrays applied to the left side of the power patch cross the zero axis at the same time to isolate one from the other. This, then, provides an antenna with isolated linear polarization of wave energy.

Figure 11:
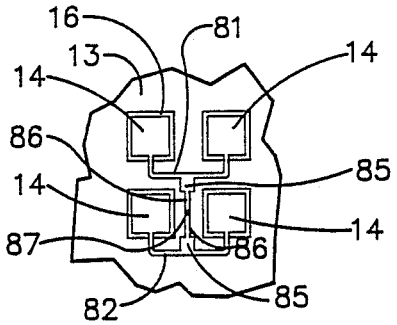
FIG. 11 is a top plan view of another embodiment of a multiple radiator array microstrip antenna using a corporate feed.

Referring now to FIG. 11 as shown a four-radiator array wherein the radiators 14 are again each disposed on a dielectric layer 16 on a ground reference 13. A first feedline 81 is connected between the upper left radiator and the upper right radiator, a second feedline 82 is connected between the lower left radiator and the lower right radiator. A feedline 86 having transformer segment 85 at the ends connects to a combining point midway between the ends of the first feedline 81 and a combining point midway between the ends of feedline 82. These feedlines 81 and 82 have portions in line with one another along a vertical line for linear and more specifically vertical polarization of wave energy. A feedpoint 87 for this antenna is midway between the ends of feedline 86. This arrangement can be characterized as a corporate fed array and provides for linear polarization. In the position shown the radiators would provide for vertical polarization and if turned 90° would provide for horizontal polarization.

The antennas shown in FIGS. 5–11 are all phased arrays meaning there is a plurality of radiators designed so they emit or receive wave energy perpendicular to the plane of the antenna. With phased arrays the wave energy from the feedpoint reaches the subarrays simultaneously but it is understood these arrays can be designed to reach the subarrays at different times to effect a steered beam.

Although the present invention has been described with a certain degree of particularity, it is understood that the present disclosure has been made by way of example and that changes in details of structure may be made without departing from the spirit thereof.

What is claimed is:

1. A microstrip antenna comprising:

a ground reference, a radiator in the form of a microstrip patch, a microstrip feedline connected at one end to an edge of said radiator, said radiator and feedline being coplanar, a first dielectric layer having a selected first dielectric constant disposed between said radiator and said ground reference, a second dielectric layer having a selected second dielectric constant disposed between said feedline and said ground reference, said first dielectric constant being different than said second dielectric constant, said first dielectric constant being selected to provide for a selected bandwidth, a selected beamwidth and a selected gain for said radiator, said second dielectric constant being selected to provide for selected low conductive losses and selected low dielectric losses for said feedline.

2. A microstrip antenna as set forth in claim 1 wherein said first dielectric constant is about 1.01 to 1.5 and said second dielectric constant is about 1.0.

3. A microstrip antenna as set forth in claim 1 wherein the edge of said first dielectric layer extends a selected slight distance beyond the edge of said radiator around the periphery of said radiator to provide for containment of an electrical field about said radiator.

4. A microstrip antenna as set forth in claim 3 wherein said first dielectric layer extends a distance of at least two to three times the thickness of said first dielectric layer.

5. An antenna as set forth in claim 1 wherein said first dielectric layer is a polyolefin.

6. An antenna as set forth in claim 6 wherein said polyolefin is polyethylene.

7. An antenna as set forth in claim 1 including a layer of superstrate on the radiator having a dielectric constant in the range of about 6 to 12 to increase gain.

8. A microstrip antenna as set forth in claim 1 wherein said radiator is of a generally square shape to restrict bandwidth.

9. A microstrip antenna comprising:

a ground reference, first, second, third and fourth radiators spaced from one another with each radiator being a microstrip patch, said second radiator being disposed below said first radiator and said third radiator being to the right of said first radiator and said fourth radiator being disposed below said third radiator and to the right of said second radiator, a first microstrip feedline connected between the bottom and top edges of said first and second radiators, respectively, and a second microstrip feedline connected between the bottom and top edges of said third and fourth radiators, respectively, to form a set of two series-connected radiator arrays, a third microstrip feedline connected to the ends of said two series-connected arrays having portions in line with said first and second feedlines and a combining point midway between its ends for vertical polarization of wave energy, said third microstrip feedline being connected at its ends to said arrays at an edge of one of a radiator of each of said arrays opposite the connection of that radiator to said first and second feedlines, a first dielectric layer having a selected first dielectric constant disposed between said radiators and said ground reference, a second dielectric layer having a selected second dielectric constant disposed between each of said feedlines and said ground reference, said first dielectric constant being different from said second dielectric constant to provide for a selected bandwidth, selected beamwidth and a selected gain for said radiators, said second dielectric constant being selected to provide for selected lower conductive losses and selected low dielectric losses for said feedlines.

10. A microstrip antenna as set forth in claim 9 wherein said first dielectric layer is a single sheet for all of said radiators that has an outer edge extending a slight distance beyond two outer edges of each of said radiators.

11. A microstrip antenna as set forth in claim 9 wherein said first dielectric layer is a separate sheet for each radiator that has an outer edge extending a slight distance beyond the edges of radiator.

12. A microstrip antenna as set forth in claim 9 wherein there are four groups of said first, second, third and fourth radiators, said groups being arranged as upper left, lower left, upper right, and lower right, a fourth microstrip feedline connected between the vertical polarization combining point of said upper left and upper right groups and a similar fourth microstrip feedline connected between the vertical polarization combining point of said lower left and lower right group, a fifth microstrip feedline connected between the combining points midway between the ends of each of said fourth feedlines, a sixth microstrip feedline connected between the combining point midway between the ends of said fifth feedline and a similar fifth microstrip feedline of a similar group of sixteen radiators, and a seventh feedline connected between the combining point midway between the ends of said sixth feedline to a similar group of thirty-two radiators and a feedpoint midway between the ends of said seventh feedline.

13. A microstrip antenna as set forth in claim 9 further including a first feedpoint connected to said combining point and a fourth microstrip feedline connected between said first and third radiators and a fifth microstrip feedline connected between said second and fourth radiators to form a second set of two series-connected arrays, a sixth microstrip feedline connected to the ends of said second set of two series connected arrays having portions in line with said fourth and fifth feedlines and a second feedpoint midway between the ends of said sixth microstrip feedline for horizontal polarization of wave energy.

14. A microstrip antenna as set forth in claim 13 including a seventh microstrip feedline connected between the combining points of said first and second set of arrays and including a slant linear polarization feedpoint midway between the ends of said seventh microstrip feedline.

15. A microstrip antenna as set forth in claim 14 including a right hand circular polarization feedpoint on said seventh feedline and a left hand circular polarization feedpoint on said seventh feedline.

16. A microstrip antenna as set forth in claim 9 wherein said radiators have a dimension of about one half wave length and are spaced apart about one half wave length from edge to adjacent edge.

17. A microstrip antenna as set forth in claim 9 wherein each radiator has a central aperture of substantially the shape of said radiator and of a dimension of about one fourth the dimension of said radiator, said first feedline being connected from opposite adjacent corners of said first and third radiators, said second feedline being connected from opposite adjacent corners of said third and fourth radiators and a third feedline connected to a corner of said second radiator and a corner of said fourth radiator, said third feedline having a combining point midway between the ends and a feedpoint connected to said combining point to provide for circular polarization of wave energy.

18. A microstrip antenna as set forth in claim 9 wherein there are four groups of said first, second, third and fourth radiators, said groups being arranged as upper left, lower left, upper right and lower right as viewed from its top, a fourth microstrip feedline connected between the vertical polarization combining point at the bottom of said upper left group and the top of said lower left group and between the vertical polarization combining point of said upper right group and said lower right group with a 180 degree phase shifter in each fourth feedline arranged so that wave energy at a first combining point midway between the ends of said fourth feedlines is in phase at said first combining points, a fifth microstrip feedline connected between the horizontal polarization combining points at opposite sides of said upper groups and between the horizontal polarization combining points at the opposite sides of said lower group with a 180 degree phase shifter in said fifth feedlines, the combined vertical polarization from said left groups being connected by a sixth microstrip feedline to the top of a power patch and from the right groups to the bottom of the power patch to provide for isolated vertical polarization, the combined horizontal polarization from said upper groups being connected by a seventh microstrip feedline to the right side of the patch and from the lower groups to the left side of said power patch to provide for isolated horizontal polarization, a vertical polarization feedpoint in said sixth microstrip feedline, and a horizontal polarization feedpoint in said seventh microstrip feedline.

19. A microstrip antenna comprising:

a ground reference, an array of first, second, third and fourth radiators spaced from one another with each radiator being in the form of a microstrip conductive patch, said second radiator being disposed to the right of said first radiator, said third radiator being below said first radiator and said fourth radiator being disposed below said first radiator and to the right of said third radiator, a first microstrip feedline connected between the bottom edges of said first radiator and second radiators, a first combining point on said first feedline midway between its ends, a second microstrip feedline connected between the bottom edges of said third and fourth radiators, a second combining point on said second feedline midway between its ends, a third microstrip feedline connected between said combining points, a feedpoint midway between the ends of said third feedline for vertical polarization of wave energy, a first dielectric layer having a first selected dielectric constant value disposed between said radiators and said ground reference, a second dielectric having a second selected dielectric constant value disposed between each of said feedlines and said ground reference, said first dielectric constant being different from said second dielectric constant value, said first dielectric constant value being selected to provide for a selected bandwidth, selected beamwidth and a selected gain for said radiators, said second dielectric constant being of a selected value to provide for selected lower conductive losses and low dielectric losses for said feedlines.

20. A microstrip antenna comprising:

a ground reference, a radiator in the form of a microstrip patch, a microstrip feedline connected at one end to an edge of said radiator, a first dielectric layer having a selected first dielectric constant disposed between said radiator and said ground reference, a second dielectric layer having a selected second dielectric constant disposed between said feedline and said ground reference, said first dielectric constant being different than said second dielectric constant, said first dielectric constant being selected to provide for a selected bandwidth, a selected beamwidth and a selected gain for said radiator, said second dielectric constant being selected to provide for selected low conductive losses and selected low dielectric losses for said feedline, said second dielectric layer being provided by having an air gap between said ground reference and said feedline.

21. A microstrip antenna comprising:

a ground reference, a radiator in the form of a microstrip patch, a microstrip feedline connected at one end to an edge of said radiator, a first dielectric layer having a selected first dielectric constant disposed between said radiator and said ground reference, a second dielectric layer having a selected second dielectric constant disposed between said feedline and said ground reference, said first dielectric constant being different than said second dielectric constant, said first dielectric constant being selected to provide for a selected bandwidth, a selected beamwidth and a selected gain for said radiator, said second dielectric constant being selected to provide for selected low conductive losses and selected low dielectric losses for said feedline, said radiator and feedline being made as a single integral strip of the same conductive material.

22. A microstrip antenna comprising:

a ground reference, a radiator in the form of a microstrip patch, a microstrip feedline connected at one end to an edge of said radiator, a first dielectric layer having a selected first dielectric constant disposed between said radiator and said ground reference, a second dielectric layer having a selected second dielectric constant disposed between said feedline and said ground reference, said first dielectric constant being different than said second dielectric constant, said first dielectric constant being selected to provide for a selected bandwidth, a selected beamwidth and a selected gain for said radiator, said second dielectric constant being selected to provide for selected low conductive losses and selected low dielectric losses for said feedline, and a carrier layer of generally uniform thickness supporting said radiator and feedline.

23. A microstrip antenna as set forth in claim 22 wherein said carrier layer is mylar.

* * * * *